United States Patent [19]

Lach

[11] 4,010,404

[45] Mar. 1, 1977

[54] TRAFFIC ERROR CORRECTING CIRCUIT FOR TRAFFIC DISPATCHING SYSTEM

[75] Inventor: Ronald Louis Lach, Arlington Heights, Ill.

[73] Assignee: Elec-Tro-Tec, Inc., Elk Grove Village, Ill.

[22] Filed: June 6, 1975

[21] Appl. No.: 584,360

[52] U.S. Cl. ..... 361/179; 340/51

[51] Int. Cl.[2] ..... H01H 47/00

[58] Field of Search ..... 317/137, 139, 141 R, 317/142 TD; 340/31, 41, 51

[56] References Cited

UNITED STATES PATENTS

| | | | |
|---|---|---|---|
| 3,206,722 | 9/1965 | Gustus et al. | 340/51 |
| 3,588,808 | 6/1971 | Gustus | 340/51 X |
| 3,886,414 | 5/1975 | Lach et al. | 317/137 |

*Primary Examiner*—Harry Moose
*Attorney, Agent, or Firm*—John K. Lucas; Robert A. Brown

[57] ABSTRACT

A traffic error correcting circuit for use with a dispatching system circuit operable to control instructing means for directing traffic to a plurality of receiving stations in response to electrical traffic request signals and request cancel signals from the stations. The error correcting circuit automatically compensates for traffic error or failure to obey the instructing means by automatically providing additional traffic request signals as required without requiring attendants at the receiving stations to constantly monitor the directed traffic.

7 Claims, 1 Drawing Figure

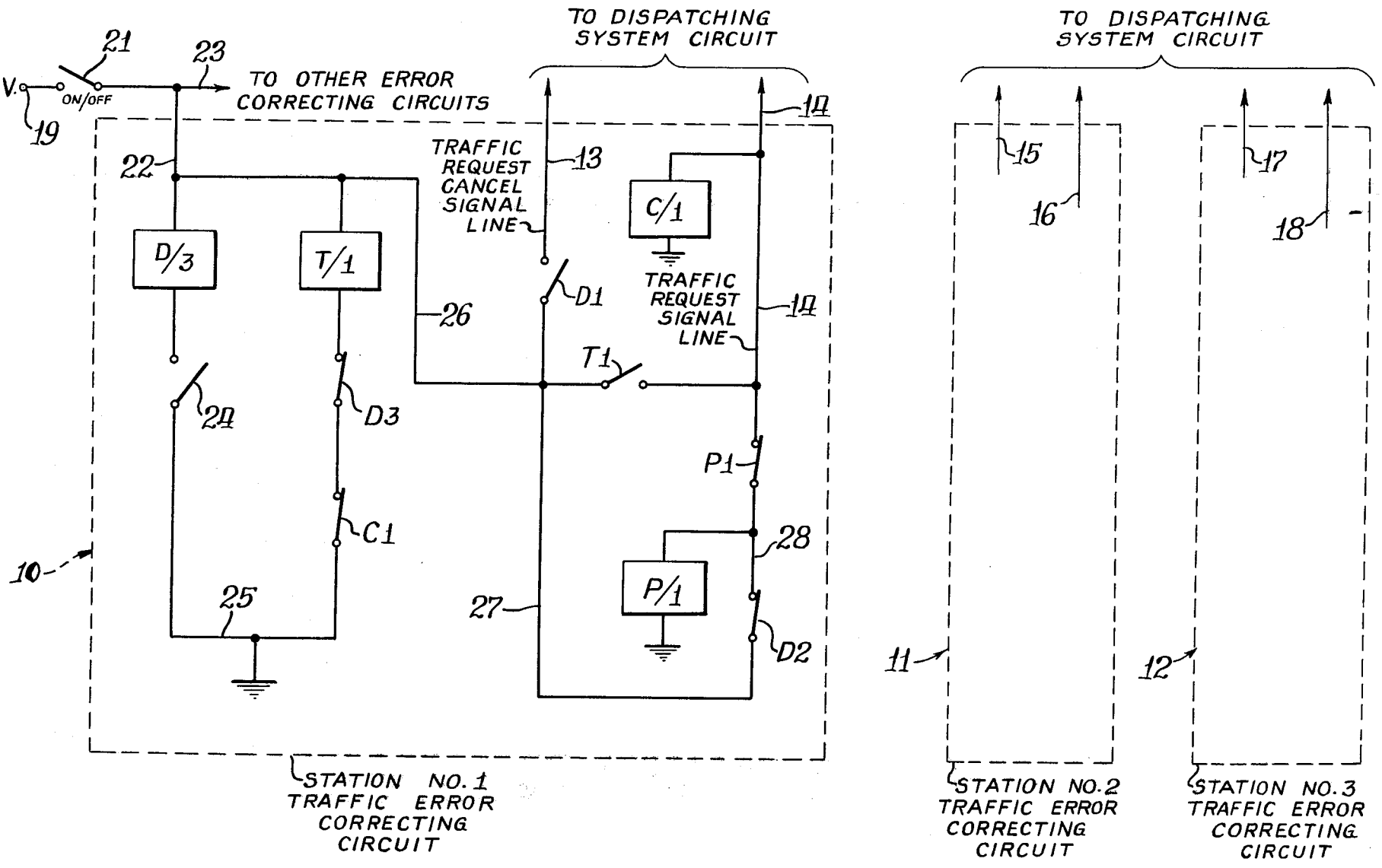
TO DISPATCHING SYSTEM CIRCUIT
TO DISPATCHING SYSTEM CIRCUIT
TO OTHER ERROR CORRECTING CIRCUITS
TRAFFIC REQUEST SIGNAL LINE
TRAFFIC REQUEST CANCEL SIGNAL LINE
C/1
P/1
T/1
D/3
D1
D2
D3
T1
P1
C1
ON/OFF
V
STATION NO.3 TRAFFIC ERROR CORRECTING CIRCUIT
STATION NO.2 TRAFFIC ERROR CORRECTING CIRCUIT
STATION NO.1 TRAFFIC ERROR CORRECTING CIRCUIT
10
11
12
13
14
15
16
17
18
19
21
22
23
24
25
26
27
28

TRAFFIC ERROR CORRECTING CIRCUIT FOR TRAFFIC DISPATCHING SYSTEM

BACKGROUND OF THE INVENTION

1. Field of the Invention

This invention relates in general to traffic dispatching systems and, more particularly, to traffic error correcting circuits for use therewith.

2. Description of the Prior Art

Traffic dispatching system circuits, particularly suitable for use in drive-in banks and the like, have been provided for efficiently controlling or directing the movement of vehicular or pedestrian traffic or other moving units from a dispatching or entrance station to a plurality of attendants at serving or receiving stations by accepting electrical traffic request signals (known as teller "calls") and request cancel signals from the receiving stations as they are generated, and subsequently presenting instruction messages at the dispatching station in a predetermined sequence. The messages are preferably presented by means of visual displays of numerical indicia corresponding to the serving or receiving stations. The traffic request signals and the traffic request cancel signals can be generated either manually or automatically. Examples of such dispatching system circuits are found in U.S. Pat. No. 3,206,722, which issued on Sept. 14, 1965 to O. T. Gustus, et al.; U.S. Pat. No. 3,588,808, which issued on June 28, 1971 to R. T. Gustus; and U.S. Pat. No. 3,886,414, which issued on May 27, 1975 to myself W. J. Brier.

In the operation of a typical dispatching system circuit, an error condition can occur whenever traffic fails to correctly respond to the message displayed by the instructing means at the dispatching or entrance station. When a customer, for example, travels to an incorrect receiving station, the station to which the customer was directed will appear to the dispatching system circuit to be in use unless the operator or teller at that station generates or places another traffic request signal to the dispatching system circuit. However, this requires the attendants at the receiving stations to constantly monitor the traffic movement. Furthermore, since dispatching system circuits are frequently used in drive-in banks wherein a small number of tellers at a remote location conduct business transactions with an even larger number of customers at remote receiving stations, the attendants, usually very busy, frequently fail to manually generate additional request signals to correct for customer errors. As a result, one or more receiving stations may not be used for an extended period of time.

SUMMARY OF THE INVENTION

The present invention comprises a simple and inexpensive solution to the above problem, and automatically corrects for traffic error or failure to correctly respond to instructions from a traffic dispatching or control system.

In general, the present invention comprises a traffic error correcting circuit for each of a plurality of receiving stations in a traffic dispatching system wherein a dispatching system circuit is operable to control instructing means for selectively assigning traffic to the receiving stations in response to electrical traffic request signals and request cancel signals from the stations. Each traffic error correcting circuit generally comprises: a voltage source; traffic detector means for operating a switch in response to presence of traffic at the station; and first switching means, second time-delay switching means and traffic request signal generating means in circuit with the voltage source. The first switching means is actuated upon operation of the switch in response to presence of traffic at the station to provide a traffic request cancel signal to the dispatching circuit. De-actuation of the first switching means in response to absence of traffic at the station serves to energize the signal generating means to provide a first traffic request signal to the dispatching circuit. De-actuation of the first switching means also serves to energize the second time-delay switching means in order to provide an additional traffic request signal to the dispatching circuit after a predetermined time interval in the absence of traffic at the station during that interval. Thus, should the first request signal be ignored, a second request signal will be automatically generated.

BRIEF DESCRIPTION OF THE DRAWINGS

The single FIGURE is a schematic diagram, employing detached relay contact notation, illustrating the basic features of the preferred embodiment of the traffic error correcting circuit of the present invention.

DESCRIPTION OF THE PREFERRED EMBODIMENT

With reference to the FIGURE, the present invention comprises a traffic error correcting circuit for each of a plurality of traffic receiving stations to which traffic is selectively assigned by a dispatching system circuit (not shown) typified by those circuits disclosed in the previously-mentioned U.S. patents. A traffic error correcting circuit enclosed within a dotted box and generally designated by reference numeral 10 is provided for a first receiving station, and identical circuits 11, 12 are provided for second and third stations, respectively. As many receiving stations as desired can be provided, and, since the circuits 10, 11 and 12 are identical, only the details of circuit 10 will be described in detail herein.

As described in detail in the previously-mentioned U.S. patents, the dispatching system circuits disclosed therein control instructing means for selectively assigning traffic to the receiving stations in response to electrical traffic request signals and request cancel signals from the stations. Such traffic request signals and request cancel signals can be either manually or automatically generated. Such signals preferably comprise pulses provided at separate inputs in the dispatching system circuit, and any suitable voltage may be used, its selection being a matter of simple design choice.

As shown in the FIGURE, circuit 10 comprises a first output or traffic request cancel signal line 13 and a second output or traffic request signal line 14 which are connected to the dispatching system circuit. Similarly, circuit 11 comprises a first output 15 and a second output 16, and circuit 12 comprises a first output 17 and a second output 18, these outputs also being connected to the dispatching system circuit. Traffic request cancel signals are provided on lines or outputs 13, 15 and 17 by circuits 10, 11 and 12 in a manner to be described; traffic request signals are provided on outputs or lines 14, 16 and 18.

Traffic error correcting circuit 10 comprises a voltage source at a terminal 19 having a suitable potential with respect to ground. Terminal 19 is connected through an on/off switch 21 to a line 22, and to a line 23 used for supplying voltage to the other error correcting circuits 11 and 12.

In the drawing, standard detached relay contact notation is utilized for simplification. Each relay is designated by a one letter symbol preceding a slash and a numeral indicating its number of contacts; each contact is designated by the letter symbol and a number without the slash. For example, the D/3 relay has relay contacts D1, D2 and D3, all of these contacts being transferred upon energization of the D/3 relay coil. The FIGURE illustrates the relay contacts in their rest positions corresponding to the de-energized or de-actuated conditions of their respective relay coils. It should also be noted that instead of relays, any other suitable switching means, such as transistors or other electronic switches, may be utilized in the present invention.

The traffic error correcting circuit 10 comprises traffic detector means (not shown) for operating a switch 24 in response to the presence of traffic at the first station. Such traffic detector means preferably comprises a known loop detector in circuit with a relay for controlling operation of normally-open switch 24. When a vehicle arrives at the first station, the vehicle detector means will close switch 24.

Circuit 10 also includes a first switching means preferably comprising an electromechanical relay, designated as D/3, connected in series with line 22, switch 24 and a ground line 25. The first switching means or D/3 relay is actuated or energized upon operation or closure of switch 24 in response to presence of traffic at the first station. Actuation of relay D/3 causes transfer of a first, normally-open contact D1, which is connected in series with the first output line 13 and the voltage source at terminal 19, to provide a traffic request cancel signal or voltage from terminal 19 through closed switch 21, line 22 and a line 26 to output 13, indicating to the dispatching system circuit that the first receiving station is in use. Energization or actuation of the D/3 relay also results in transfer of a second, normally-closed contact D2 in series with the voltage source at terminal 19 through line 22, line 26 and a line 27. The D2 contact is also in series with the second output or traffic request signal line 14 and also a traffic request signal or pulse generating means preferably comprising an electromechanical relay P/1 connected from a line 28 to ground, this relay having a contact P1 in series with the second output 14 and the D2 contact. Energization or actuation of the D/3 relay also serves to open a third, normally-closed contact D3 in series with line 26, a second time-delay switching means preferably comprising an electromechanical relay T/1, and a normally-closed contact C1 of a third switching means preferably comprising an electromechanical relay C/1 connected to the second output line 14 and ground.

In response to the absence of traffic at the first receiving station, the traffic detector means will open switch 24, causing de-actuation or de-energization of the D/3 relay. This will cause opening of the D1 contact to remove voltage from the traffic request cancel signal or first output line 13. In addition, de-actuation of the D/3 relay will result in closure of the D2 contact, providing energization to the P/1 relay through line 28, and also to the traffic request signal or second output line 14 through normally closed contact P1 until the P/1 relay is energized, at which time the P1 contact will open. As a result, a traffic request signal or voltage pulse will appear on the second output line 14.

De-actuation of the D/3 relay also serves to energize the second time-delay switching means or relay T/1 from line 26 through the normally closed C1 contact of the third switching means or C/1 relay, the C1 contact being connected to the ground line or lead 25. The T/1 relay is a known time-delay relay which becomes energized after a predetermined time interval, preferably on the order of 20 seconds, unless its energizing circuit is interrupted during that interval. Accordingly, when the traffic detector means signals the absence of traffic from the first receiving station, the D/3 relay provides a first traffic request signal to the second output line 14 through the agency of the D2 contact and the traffic request signal generating means comprising the P/1 relay. If traffic does not arrive at the first receiving station within the predetermined time interval of approximately 20 seconds, the T/1 relay will become energized, causing transfer of its associated normally-open T1 contact connected to the junction of lines 26 and 27 and also to the second output or traffic request signal line 14 to provide an additional traffic request signal or call. If, however, traffic arrives at the first receiving station during the predetermined time interval during which the T/1 relay is being prepared to transfer, the presence of traffic will energize the D/3 relay, causing resultant transfer of its D3 contact to interrupt the supply to the T/1 relay. Thus, under normal operation, the first traffic request signal provided by the traffic request signal generating means comprising the P/1 relay will enable the dispatching system circuit to actuate its instructing means to indicate that traffic should move to the first receiving station. If, however, this instruction is ignored or disobeyed within the predetermined time period determined by the characteristics of the T/1 relay, this relay will provide an additional traffic request signal to compensate for the traffic error in failing to arrive at the first receiving station.

The traffic error correcting circuit 10 preferably includes the third switching means, the C/1 relay, which is operable to inhibit operation of the T/1 relay in response to a traffic request signal generated or existing during the predetermined time interval during which the T/1 relay is being prepared to operate. The C/1 relay comprises a relay operatively energized in response to a traffic request signal on the second output or line 14 generated either automatically or manually by an attendant noticing the customer error and desiring to manually introduce an additional call or traffic request signal in order to compensate for the error.

The first switching means or D/3 relay preferably comprises a time-delay switching means de-actuated after a second predetermined time interval, on the order of 7 seconds, following absence of traffic from the first receiving station. This delay in de-actuation of the D/3 relay enables erring traffic incorrectly situated behind the departing traffic to move into position in the first receiving station, thereby compensating for traffic error.

It will be noted that the D1 contact of the D/3 relay provides the traffic request cancel signal on the first output 13 upon energization of the D/3 relay in response to the presence of traffic at the first receiving station. The operation of the D1 contact removes or cancels a call or request signal from the first receiving station whenever traffic erroneously moves to the first station which had not previously placed a call.

Finally, it should be noted that the traffic request signal generating means, preferably a pulse generating means, may comprise a previously charged capacitor instead of an electromechanical relay.

It is thought that the invention and many of its attendant advantages will be understood from the foregoing description, and it is apparent that various changes may be made in the form, construction and arrangement of its component parts without departing from the spirit and scope of the invention or sacrificing all of its material advantages, the form described being merely a preferred embodiment thereof.

The embodiments of the invention in which an exclusive property or privilege is claimed are defined as follows:

1. For use with a dispatching system circuit operable to control instructing means for selectively assigning traffic to a plurality of receiving stations in response to electrical traffic request signals and request cancel signals from said stations, a traffic error correcting circuit for each said station, comprising: a voltage source; traffic detector means for operating a switch in response to presence of traffic at said station; and first switching means, second time-delay switching means and traffic request signal generating means in circuit with said source; said first switching means being in circuit with said switch and being actuated upon operating thereof in response to presence of traffic at said station to provide a traffic request cancel signal at a first output to the dispatching circuit; de-actuation of said first switching means in response to absence of traffic at said station serving to energize said signal generating means from said source to provide a first traffic request signal at a second output to said dispatching circuit; de-actuation of said first switching means also serving to energize said second time-delay switching means in order to provide an additional traffic request signal at said second output after a predetermined time interval in the absence of traffic at said station during said interval.

2. The traffic error correcting circuit of claim 1, wherein said first switching means comprises a time-delay switching means de-actuated after a second time interval following absence of traffic from said station.

3. The traffic error correcting circuit of claim 1, and third switching means in circuit with said second output and said second time-delay switching means and being operable to inhibit energization thereof in response to a traffic request signal during said interval.

4. The traffic error correcting circuit of claim 3, wherein said third switching means comprises an electromechanical relay connected to said second output and having a contact in series with said second switching means.

5. The traffic error correcting circuit of claim 3, wherein said first switching means comprises an electromechanical relay connected in series with said voltage source and said switch and having a first contact in series with said voltage source and said first output, a second contact in series with said voltage source and said traffic request signal generating means and a third contact in series with said voltage source and said second switching means; and wherein said second switching means comprises an electromechanical relay connected in series with said voltage source, said third switching means and said third contact, and comprises a contact in series with said voltage source and said second output.

6. The traffic error correcting circuit of claim 1, wherein said traffic request signal generating means comprises a pulse generating means.

7. The traffic error correcting circuit of claim 6, wherein said pulse generating means comprises an electromechanical relay having a contact in series circuit with said voltage source and said second output.

* * * * *